US006786567B1

(12) United States Patent
Yoshino

(10) Patent No.: US 6,786,567 B1
(45) **Date of Patent: *Sep. 7, 2004**

(54) INK JET APPARATUS AND WASTE LIQUID ABSORBING METHOD

(75) Inventor: Hiroshi Yoshino, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/699,387

(22) Filed: Oct. 31, 2000

Related U.S. Application Data

(62) Division of application No. 08/522,917, filed on Sep. 1, 1995, now Pat. No. 6,252,615.

(30) Foreign Application Priority Data

Sep. 2, 1994 (JP) ..... 6/210218

(51) Int. Cl.[7] ..... B41J 2/165
(52) U.S. Cl. ..... 347/36
(58) Field of Search ..... 347/21, 22, 29, 347/30, 36

(56) References Cited

U.S. PATENT DOCUMENTS

| | | | | |
|---|---|---|---|---|
| 4,437,104 A | | 3/1984 | Hudson | 347/86 |
| 4,506,277 A | | 3/1985 | Terasawa | 347/36 |
| 4,538,160 A | | 8/1985 | Uchiyama | 347/101 |
| 4,901,094 A | | 2/1990 | Iwagami et al. | 347/36 |
| 4,965,596 A | | 10/1990 | Nagoshi et al. | 347/36 |
| 5,155,497 A | | 10/1992 | Martin et al. | 347/33 |
| 5,157,421 A | | 10/1992 | Kitahara | 347/86 |
| 5,237,341 A | | 8/1993 | Iwagami et al. | 347/28 |
| 5,396,271 A | | 3/1995 | Prenath | 347/33 |
| 5,555,008 A | | 9/1996 | Stoffel et al. | 347/100 |
| 5,606,354 A | | 2/1997 | Bekki et al. | 347/33 |
| 5,608,432 A | | 3/1997 | Yamaguchi | 347/33 |
| 5,617,124 A | | 4/1997 | Taylor et al. | 347/35 |
| 5,618,338 A | | 4/1997 | Kurabayashi et al. | 106/31.37 |
| 5,625,385 A | | 4/1997 | Suzuki | 347/24 |
| 5,635,969 A | | 6/1997 | Allen | 347/96 |
| 5,640,187 A | | 6/1997 | Kashiwazaki et al. | 347/101 |
| 5,680,162 A | | 10/1997 | Taylor et al. | 347/36 |
| 6,155,666 A | * | 12/2000 | Sugimoto et al. | 347/24 |
| 6,252,615 B1 | * | 6/2001 | Yoshino | 347/36 |

FOREIGN PATENT DOCUMENTS

| | | |
|---|---|---|
| EP | 0323262 | 12/1988 |
| EP | 0581135 | 2/1994 |
| EP | 0585923 | 3/1994 |
| JP | 57-022065 | 2/1982 |
| JP | 61-024457 | 2/1986 |
| JP | 01-063185 | 3/1989 |
| JP | 01-184146 | 7/1989 |

* cited by examiner

*Primary Examiner*—Michael Nghiem
(74) *Attorney, Agent, or Firm*—Fitzpatrick, Cella, Harper & Scinto

(57) ABSTRACT

Printing on a printing medium with ink and treatment liquid having a function of setting ink, by using an apparatus which includes an ink ejection port for ejecting ink, a treatment liquid ejection port for ejecting treatment liquid, a waste liquid accommodating substance for accommodating waste liquid, a first introducing path for introducing waste ink discharged by recovery operation from the ink ejection port into a first portion of the waste liquid accommodating substance, and a second introducing path for introducing, independently of waste ink, waste treatment, liquid discharged by recovery operation from the treatment liquid ejection port into a second portion separated from the first portion of the waste liquid accommodating substance.

6 Claims, 8 Drawing Sheets

INK JET APPARATUS AND WASTE LIQUID ABSORBING METHOD

This application is a division of U.S. application Ser. No. 08/522,917 filed Sep. 1, 1995, now U.S. Pat. No. 6,252,615.

BACKGROUND OF THE INVENTION

FIELD OF THE INVENTION

The present invention relates generally to an ink jet apparatus and a waste liquid absorbing method each of which assure that an image having a high quality can be obtained on a printing medium. More particularly, the present invention relates to an ink jet apparatus for ejecting on the printing medium liquid having a function of undissolving a coloring material in ink prior to ejection of the ink.

The present invention is applicable to all kinds of instruments for which a printing medium such as a sheet of paper, unwoven fabric, a sheet of OHP film or the like is used. The applicable instrument is typically exemplified by an office machine and a mass production machine such as a printer, a copying machine, a facsimile or the like.

An ink jet printing method is utilized for a printer, a copying machine, a facsimile or the like for the reasons that a low level of noisy sound is generated, the ink jet method is practiced at a low running cost, an apparatus is easily designed with small dimensions, and an image is easily formed by using colored inks.

However, the ink jet printing system has the following specific problems to be solved.

(1) Since a printing operation is performed by ejecting ink droplets from an ink jet head to a sheet of paper, a sheet of OHP film or a similar printing medium, fine ink mist other than the ejected main ink droplets or ink mist ejected to the printing medium rebounds to an ink jet head, causing the ink mist to adhere to an ink ejecting port surface until a large quantity of ink mist get together around the ink ejecting port. In addition, when paper powder or a similar foreign material adheres to the fine mist, ink ejection is obstructed, causing ink droplets to be ejected in an unexpected direction. In an extreme case, ink droplets can not be ejected.

(2) Unless the ink jet head is continuously ejected for a long time inclusive of non-printing time, ink in the nozzle is dried due to vaporization, resulting in the nozzle being clogged with ink having increased viscosity or solidified ink. Thus, there arises a malfunction that ink is ejected in the warped state or no ink ejection is effected.

The ink jet apparatus is generally equipped with recovering means as means for solving the problems as mentioned in the paragraph (1) and the paragraph (2). Specifically, when no printing operation is performed, an ink jet head is capped with capping means for the purpose of preventing ink in a nozzle of the ink jet head from being vaporized and dried, resulting in the ink having increased viscosity or adherence to the nozzle. In the case that incorrect ejection is effected due to increased viscosity or adherence, foreign material which can not be removed by a blade adhere to the ink ejecting port surface, ink having increased viscosity in the nozzle is discharged by operating a suction pump connected to the cap so as to conduct recovering treatment for recovering normal ejection. Here, the discharged ink is sucked in a waste ink absorbing substance disposed in a housing of the apparatus via piping extending downstream of the suction pump.

A capacity of the waste ink absorbing substance is determined depending on the number of times of incorrect printings, the number of times of recovering operations, a quantity of ink squeezed or sucked every recovering operation or a quantity of ink mist discharged from the ink jet head, it is recommendable from the viewpoint of the whole structure of the apparatus that the waste ink absorbing substance is compactly designed to have a small capacity because it is expected that the position where it is disposed is not restricted, and moreover, it is fabricated at a low cost. However, if a capacity of the waste ink absorbing substance is set to a quantity originally required by the apparatus, there arises an inconvenience of maintenance that the waste ink absorbing substance is periodically replaced with a new one. On the contrary, when a waste ink absorbing substance having a required capacity is disposed on the apparatus, the waste ink absorbing substance is relatively enlarged, causing it to be fabricated at an increased cost, and moreover, the housing of the apparatus is enlarged in size. In this connection, a technology for minimizing a volume of the waste ink absorbing substance by utilizing vaporization of ink is disclosed on an official gazette of Japanese Patent Application Laid-Open No. 22065/1982.

On the other hand, in the case that an image has insufficient water resistibility or a color image is formed on a printing medium that is called a plain paper with the aforementioned apparatus having an ink jet printing method applied thereto, a request for an image having a high density without an occurrence of feathering and a request for an image having no oozing of coloring substance among colors can not exist together, resulting in a quality of colored image being remarkably degraded.

In recent years, as a method of improving water resistibility of an image, ink containing a coloring material having resistibility against water has been put in practical use. However, since this ink does not still have sufficient water resistibility, and it is ink which is theoretically hardly dissolved in ink after drying, it has a drawback that ink is liable to cause a failure of ink ejection.

In view of the foregoing fact, a technology that transparent or translucent treatment liquid containing a coloring substance which is insoluble in a solvent adheres to a printing medium with the aid of an ink jet head directly before a printing operation is disclosed in an official gazette of Japanese Patent Application Laid-Open No. 63185/1989. However, with respect to this technology, the problem specific to the ink jet apparatus is applicable to a head for the treatment liquid, and when the treatment liquid is not ejected from the nozzle, there sometimes arises an occasion that water resistibility and a quality of image corresponding to the failure of ejection of the treatment liquid are remarkably degraded. For this reason, it is necessary that the head for the treatment liquid is equipped with recovering means in the same manner as the ink jet head.

FIG. 9 schematically shows by way of example the structure of a conventional ink jet apparatus which is equipped not only with recovering means for an ink jet head but also with recovering means for a head for treatment liquid. Here, each of a plurality of ink jet cartridges 1 includes an ink tank portion. A plurality of ink jet cartridges 1 each containing treatment liquid for making coloring ink and coloring material for printing insoluble are mounted or a carriage at predetermined positions. The carriage 3 is slidably supported a shaft 4 extending in the main scanning direction, and a driving belt 5 serves to transmit the driving force of the driving motor 6 for reciprocably displacing the carriage 3. A printing medium 11 is conveyed while its printing surface is flatly restricted by a platen 12. At this time, ink jet head portions 2 of the ink jet cartridges 1 mounted on the carriage 3 is projected downward of the carriage 3 to assume a position between two sets of conveying rollers (not shown) of the printing medium 11, and ink ejecting port forming surfaces of the ink jet head portions 2 faces to the printing medium 11 which is located in parallel thereto while comes in pressure contact with the guide surface of the platen 12. In addition, a recovering system unit 100 is arranged on the home position side located on the right-hand side in FIG. 9. A plurality of cap units 101 are arranged in the recovering system unit 100 corresponding to the respective ink jet head portions 2 of a plurality of ink jet cartridges 101. The cap units 101 can be raised and lowered in the vertical direction. When the carriage 3 is located at the home position, it is connected to the ink jet head portions 2 so as to cap the latter wherewith to prevent an occurrence of incorrect ejection due to increased viscosity or chemical fixing induced by vaporization of ink in the ink ejection port. A pump unit (not shown) is disposed in the recovering system unit 100. This pump unit serves to generate negative pressure when suction recovering treatment is conducted by connecting the cap unit 101 to the ink jet head portions 2. As the suction recovering treatment is conducted, the ink and the treatment liquid sucked from the ink jet head is absorbed in a waste liquid absorbing substance 103 via a tube 102 by driving the pump unit.

When suction recovering treatment is conducted with the ink jet apparatus as mentioned above, two kinds of materials, i.e, the treatment liquid and ink are present in the waste liquid absorbed in the waste liquid absorbing substance 103. However, when these two kinds of waste liquids are mixed with each other, the mixture has a nature that viscosity is increased. Thus, there arise the following problems.

(1) When both liquids are absorbed in a single waste liquid absorbing substance for the purpose of saving a space, increased viscosity or setting is caused with the result that it becomes difficult to absorb waste liquid in the whole waste liquid absorbing substance, and moreover, it is impossible to absorb the waste liquid at a high efficiency.

(2) When absorbing substances are provided separately for ink and treatment liquid so as to avoid increased viscosity of the waste liquid, cost is increased and an apparatus is enlarged in size. In addition, a replacement frequency is twice increased when the absorbing substance is saturated with the waste liquid.

OBJECT OF THE INVENTION

An object of the present invention is to provide an ink jet apparatus which improves the drawbacks inherent to the prior art and realizes an ink jet apparatus which includes a waste liquid absorbing substance in which waste liquid can effectively be held in the case that ink and waste liquid having setting/increased viscosity after completion of reaction are absorbed in a single waste liquid absorbing body substance.

SUMMARY OF THE INVENTION

According to one aspect of the present invention, there is provided an ink jet apparatus for pretreating to a printing medium with treatment liquid having a function of setting ink by using a first ink jet head, and for printing on the printing medium with ink by using a second ink jet head, wherein the apparatus comprises first recovering means for recovering an ejecting port of the first ink jet head, second recovering means for recovering an ejecting port of the second ink jet head, a waste liquid absorbing substance for absorbing waste liquid discharged from the first recovering means and the second recovering means, first waste liquid transferring means for transferring the waste liquid discharged from the first recovering means the waste liquid absorbing substance, and second waste liquid transferring means for transferring the waste liquid discharged from the second recovering means into the waste liquid absorbing substance, wherein a discharge end of the first waste liquid displacing means is located in vicinity of one end of the waste liquid absorbing substance, and a discharge end of the second waste liquid displacing means is located in vicinity of other end of the waste liquid absorbing substance.

It is acceptable that the waste liquid absorbing substance is formed in a U-shaped configuration, the discharge end of the first waste liquid displacing means is located in vicinity of one end of the U-shaped configuration, and the discharge end of the second waste liquid displacing means is located in the vicinity of other end of the U-shaped configuration of the waste liquid absorbing substance. It is also acceptable that the treatment liquid contains low molecular weight and high molecular weight cationic materials, while the ink contains an anionic dye or contains at least anionic compound and pigment. In addition, the ink jet head includes as an energy generating element an electrothermal transducer for generating thermal energy so as to allow a phenomenon of film boiling to appear in ink.

According to other aspect of the present invention, there is provided a waste liquid absorbing method for an apparatus for performing a printing operation by utilizing a treatment liquid having a function for setting ink as well as an ink, the apparatus including a waste liquid absorbing substance for absorbing the treatment liquid and the ink as waste liquid, wherein the treatment liquid and the ink are respectively absorbed in vicinity of the opposite ends of the waste liquid absorbing substance.

It is acceptable that the waste ink absorbing substance is formed in the U-shaped configuration, and the treatment liquid and the ink are absorbed in vicinity of the opposite ends of the waste liquid absorbing substance.

With the ink jet apparatus constructed in that way, since absorbing ends are separated in a single waste liquid absorbing substance so as not to allow both the waste liquids to be mixed with each other without an occurrence of chemical fixing, it is possible to elevate an absorbing efficiency, and minimize a volume of the waste liquid absorbing substance, and moreover, construct the apparatus compactly. Consequently, the apparatus can be constructed with smaller dimensions at a reduced cost. In addition, there is no need of replacing the waste liquid absorbing substance with another one or the number of times of replacing the waste liquid absorbing substance with another one can be reduced.

The above and other objects, effects, features and advantages of the present invention will become more apparent from the following description of embodiments thereof taken in conjunction with the accompanying drawings.

DESCRIPTION OF THE PREFERRED EMBODIMENTS

The present invention will be described in detail hereinafter with reference to the accompanying drawings which illustrate two preferred embodiments thereof.

The present invention will be described below in detail with respect to two embodiments.

Figure 1:
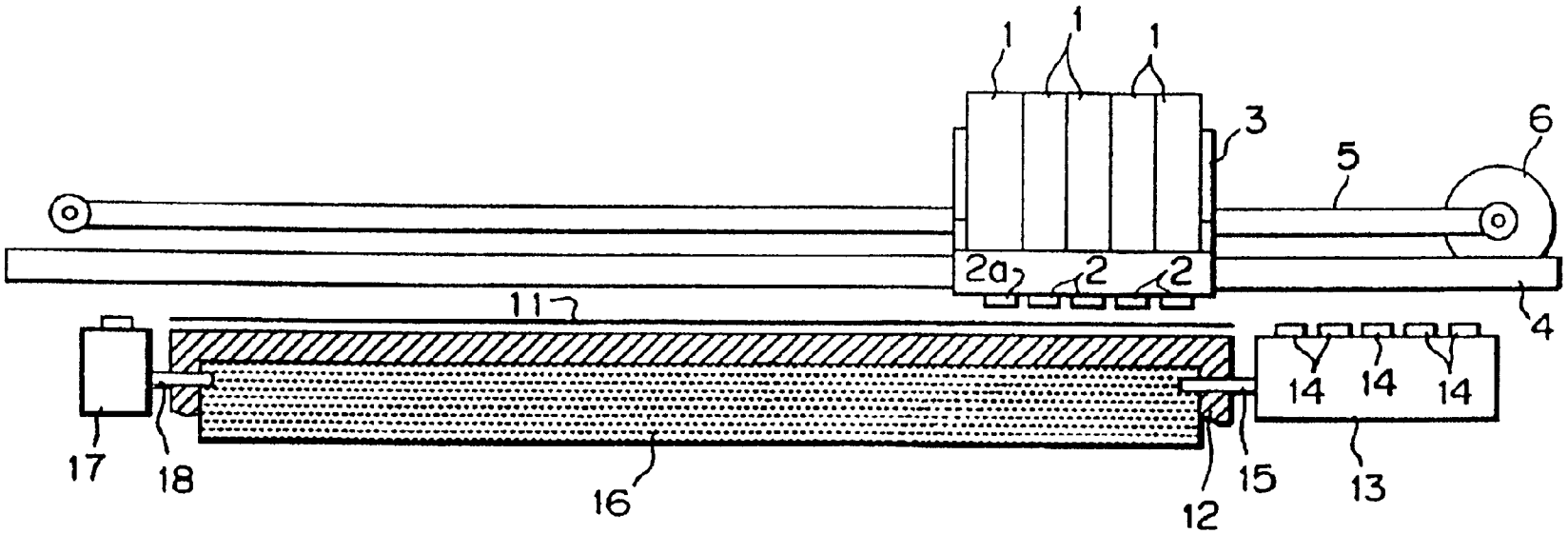
FIG. 1 is a front view which schematically shows the structure of an ink jet apparatus constructed in accordance with a first embodiment of the present invention.
Figure 2:
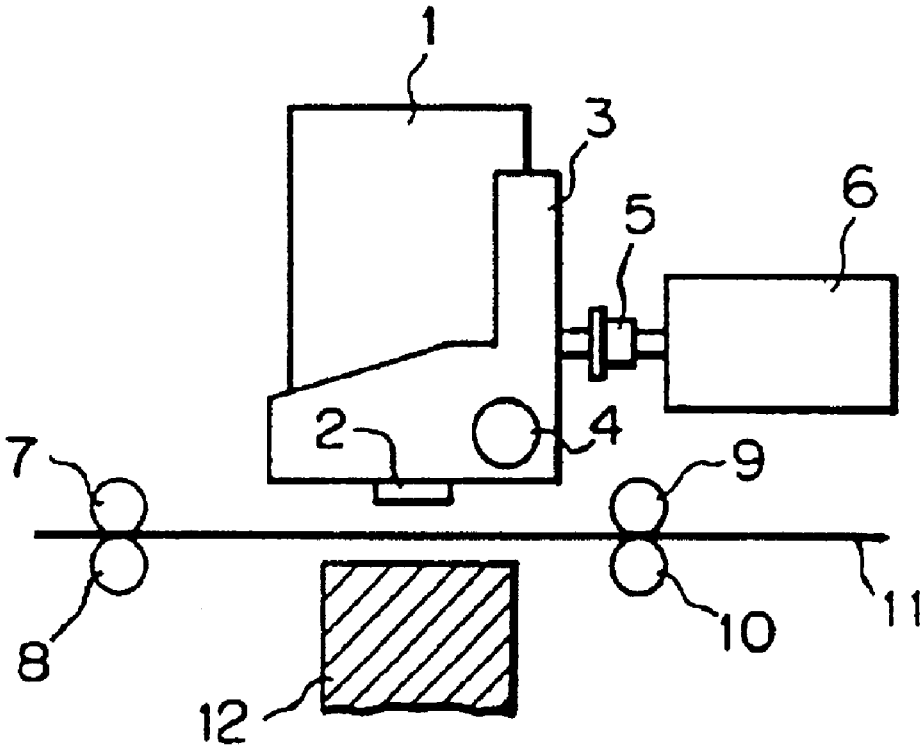
FIG. 2 is a side view of the ink jet apparatus shown in FIG. 1.

As shown in FIG. 1 which schematically shows by way of front view the structure of an ink jet apparatus constructed in accordance with a first embodiment of the present invention and FIG. 2 which shows the side view of the ink jet apparatus, each of a plurality of ink cartridges 1 includes upper ink tank portions and lower ink jet head portions 2 and further includes a connector (not shown) which receive a signal for driving an ink jet head. A carriage 3 carries a plurality of ink jet cartridges 1 in positions and includes a connector holder (not shown) for transmitting signals for driving an ink jet head and is electrically connected to the ink jet head. In this embodiment, a plurality of cartridges containing yellow ink, magenta ink, cyan ink and black ink respectively and a cartridge containing treatment liquid for making coloring material insoluble are mounted on the carriage 3 in order from the right to the left. The carriage 3 is slidably supported on a guide shaft 4 extending in the main scanning direction, and a driving belt 5 serves to transmit the driving force of a driving motor 6 for reciprocably displace the driving belt 5. Pairs of conveying rollers 7,8, 9 and 10 for conveying a printing medium 11 while the latter is clamped are arranged before and behind the printing position of the ink jet head. The printing medium 11 is conveyed while it is brought in pressure contact with a platen 12 for restricting the printing surface in the flattened state. At this time, the ink jet head portions 2 of the ink jet cartridges 1 mounted on the carriage 3 are projected downward of the carriage 3 and are located between conveying rollers 7 and 9 for conveying the printing medium 11, and ink ejecting port forming surfaces of the ink jet head portions 2 face to the printing medium 11 in the parallel state which is brought in pressure contact with the guide surface of the platen 12.

In the ink jet apparatus constructed in accordance with this embodiment, a recovering system unit 13 is arranged on the home position side located on the right-hand side as seen in FIG. 1. A plurality of cap units 14 are arranged corresponding to the ink jet head portions 2 of a plurality of ink jet cartridges 1, and the cap units 14 can be raised and lowered in vertical direction. When the carriage 3 is located at the home position, each of cap units 14 is connected to the ink jet head portions 2 in order to prevent an occurrence of incorrect ejection due to increased viscosity and evaporation of the ink in an ink ejecting port of the ink jet head.

In addition, a pump unit (not shown) is disposed in the recovering system unit 13. When the ink jet head performs incorrect ejection, this pump unit induces negative pressure at the time of suction recovering treatment performed while the cap units 14 are connected to the ink jet head portions 2. During such suction recovering treatment, the ink sucked in the ink jet head is absorbed in a waste liquid absorbing substance 16 via a tube 15 which serves as waste liquid conveying means from the pump unit. In this embodiment, the cap for capping the treatment liquid head arranged at the left end of the recovering system unit 13 does not connect to the pump unit.

On the other hand, in this embodiment, a treatment liquid recovering unit 17 exclusively for the cartridge having the treatment liquid received therein is disposed on the left-hand side as seen in FIG. 1 so that suction recovering treatment can be performed when the treatment liquid ejection head 24 can not correctly eject. A pump unit (not shown) is disposed also in the treatment liquid recovering system unit 17 in the same manner as the recovering system unit 13 so as to conduct suction recovering treatment in the case that the treatment liquid head does not correctly eject. The treatment liquid discharged from the treatment liquid ejection head by such recovering treatment is absorbed in the waste liquid absorbing substance 16 via a tube 18 serving as waste liquid conveying means. The reason why the treatment liquid recovering system unit 17 is separated from the recovering system unit 13 is to avoid an occurrence of incorrect suction due to increased viscosity induced by mixing the ink and treatment liquid with each other in the pump.

As described above, in this embodiment, the discharge ends of the discharge tubes 15 and 18 for discharging waste liquids from the recovering units 13 and 17 are disposed on the opposite ends of the waste liquid absorbing substance 16 which linearly extends in the leftward/rightward direction as seen in the drawings. A manner that the waste liquid is absorbed in the waste liquid absorbing substance will be described as follows.

Figure 3:
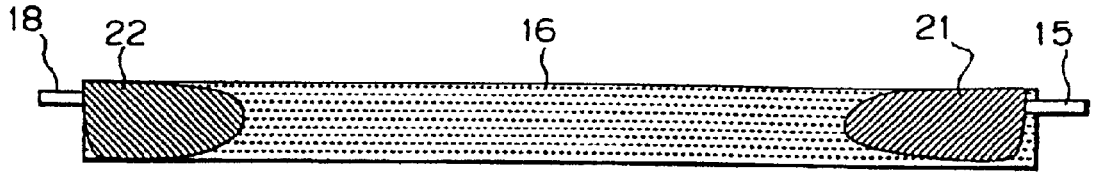
FIG. 3 is a schematic view which shows that a waste liquid absorbing substance of the first embodiment is not saturated.
Figure 4:
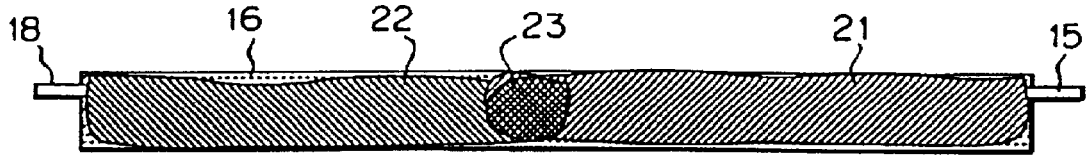
FIG. 4 is a schematic view which shows that the waste liquid absorbing substance of the first embodiment is saturated with waste liquids.

FIG. 3 and FIG. 4 show a manner that the waste liquid is absorbed in the waste liquid absorbing substance 16 in accordance with this embodiment. Especially, FIG. 3 shows that the waste liquid absorbing substance 16 has still allowance in capacity and FIG. 4 shows that the waste liquid absorbing substance 16 is substantially saturated with waste liquids.

In the state as shown in FIG. 3, ink waste liquid 21 and treatment liquid waste liquid 22 absorbed in the waste liquid absorbing substance 16 through the tubes 15 and 18 are separately stored in the opposite end ranges of the waste liquid absorbing substance 16. For this reason, it can be considered that two kinds of waste liquids are absorbed in separate waste liquid absorbing substances. In this case, since the two waste liquids do not interfere with each other, there is no danger that a malfunction of increased viscosity or setting occurs. Thus, waste liquid is absorbed in the waste liquid absorbing substance 16 without any obstruction.

On the other hand, in the state shown in FIG. 4, the waste liquid absorbing substance 16 is substantially saturated with two kinds of waste liquids 21 and 22, and a jelly-like reaction product 23 is formed at the substantial central part of the waste liquid absorbing substance 16. However, since the waste liquid absorbing substance 16 is substantially saturated with the waste liquids, the jelly-like reaction product 23 does not become obstruction for the waste liquid absorption.

A balance between a quantity of waste liquid of treatment liquid and a quantity of waste liquid of ink varies due to various factors such as humidity, temperature, printing frequency or the like, and since the position where both liquids mix with each other is automatically regulated even when the foregoing balance is largely deviated from the neutral state, absorption can be achieved with the use of the whole volume of the waste liquid absorbing substance 16. Thus, the volume of the waste liquid absorbing substance 16 can be minimized, resulting in a fabrication cost being reduced. In addition, since the waste liquid absorbing efficiency is increased, there is no need of exchanging the waste liquid absorbing substance 16 with another one or there is few frequency of exchanging it with another one.

Since the ink jet apparatus having the treatment liquids used therefor is constructed in the above-described manner, the volume of the waste liquid absorbing substance 16 can effectively be utilized with simple structure and at a low cost, whereby a high quality of image can be obtained without any undesirable increased cost.

In this embodiment, the waste liquid absorbing substance 16 extends by a long stance in the horizontal direction and the waste liquids are absorbed at the opposite ends of the waste liquid absorbing substance 16. Otherwise, the waste liquid absorbing substance 16 may extend by a long distance in the vertical direction so that the waste liquids are absorbed at upper and lower ends of the waste liquid absorbing substance 16. Alternatively, the waste liquid absorbing substrate may be designed in a cubic configuration so that the waste liquids are absorbed at the opposite diametrical ends of the waste ink absorbing substance 16.

Here, as an example, the colorless treatment liquid for making ink dyestuff insoluble can be obtained in the following manner.

Specifically, after the following components are mixed together and dissolved, and the mixture is pressure-filtered by using a membrane filter of 0.22 $\mu$m in pore size (tradename: fuloropore filter manufactured by Sumitomo Denki Kogyo K. K.), and thereafter, pH of the mixture is adjusted to a level of 4.8 by adding sodium hydroxide whereby colorless liquid A1 can be obtained.

[Components of A1]

low molecular weight ingredients of cationic compound stearyl-trimethyl ammonium chloride (tradename: Electrostopper QE, manufactured by Kao Co.) 2.0% high molecular weight ingredients of cationic compound polyaminesulfon (having an average molecular weight of 5000)

(tradename: PAS-92, manufactured by Nitto Boseki Co.) 3.0% thiodiglycol 1.0% water balance

Preferable examples of ink which becomes insoluble by mixing the aforementioned colorless liquid can be noted below.

Specifically, the following components are mixed together, the resultant mixture is pressure-filtered with the use of a membrane filter of 0.22 $\mu$m in pore size (tradename: Chroroporefilter, manufactured by Sumitomo Denki Kogyo Co.) so that yellow ink Y1, magenta ink M1, cyan ink C1 and black ink K1 can be obtained.

Y1

C. I. direct yellow 142 2% thiodiglycol 10% acetynol EH (manufactured by Kawaken Finechemical Co.) 0.05% water balance

M1 having the same composition as that of Y1 other than that the dyestuff is changed to 2.5% of C. I. acid red 289.

C1 having the same composition as that of Y1 other than that the dyestuff is changed to 2.5% of acid blue 9.

K1 having the same composition as that of Y1 other than that the dyestuff is changed to 3% of C. I. food black 2.

According to the present invention, the aforementioned colorless liquid and ink are mixed with each other at the position on the printing medium or at the position where they penetrate in the printing medium. As a result, the ingredient having a low molecular weight among the cationic material contained in the colorless liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight are adsorbed by the ingredient having a high molecular weight and contained in the colorless liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight of the cationic material caused by way of the aforementioned mechanism, the anionic dye and the cationic material has increased viscosity. Thus, since the aggregated material does not move as the liquid medium moves, ink dots adjacent to each other are formed by inks each having a different color like at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

When the present invention is carried out, since there is no need of using the cationic material having a high molecular weight and polyvalent metallic salts like the prior art or even though there is need of using them, it is sufficient that they are assistantly used to improve an effect of the present invention, a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

With respect to a printing medium usable for carrying out the present invention, there is no specific restriction, so called plain paper such as copying paper, bond paper or the like conventionally used can preferably be used. Of course, coated paper specially prepared for ink jet printing and OHP transparent film are preferably used. In addition, ordinary high quality paper and bright coated paper can preferably be used.

Ink usable for carrying out the present invention should not be limited only to dyestuff ink, and pigment ink having pigment dispersed therein can also be used. Any type of treatment liquid can be used, provided that pigment is aggregated with it. The following pigment ink can be noted as an example of pigment ink adapted to cause aggregation by mixing with the colorless liquid A1. As mentioned below, yellow ink Y2, magenta ink M2, cyan ink C2 and black ink K2 each containing pigment and anionic compound can be obtained.

[Black Ink K2]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methaacrylic acid ethylacryrate of 20% having an acid value of 400 and average molecular weight of 6000, neutralizing agent: potassium hydroxide) as dispersing agent to conduct dispersion treatment for 3 hours while water cooling the sand mill. After completion of dispersion, the resultant mixture has a viscosity of 9 cps and pH of 10.0. The dispersing liquid is poured in a centrifugal separator to remove coarse particles, and carbon black dispersing element having an average grain size is 10 nm is produced.

(Composition of Carbon Black Dispersing Element)

| | |
|---|---|
| P-1 aqueous solution (solid ingredient of 20%) | 40 parts |
| carbon black (Mogul L; manufactured by Cablack Co.) | 24 parts |
| glycerol | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow Ink Y2]

Anionic high molecular P-2 (aqueous solution containing a solid ingredient of 20% of stylen acrlylic acid methyl methaacrylate having an acid value of 280 and an average molecular weight of 11,000, neutralizing agent: diethanolamine) is used as a dispersing agent and dispersive treatment is conducted in the same manner as production of the black ink K2 whereby yellow color dispersing element having an average granular diameter 103 nm is produced.

(Composition of Yellow Dispersant)

| | |
|---|---|
| P-2 aqueous solution (having a solid ingredient of 20%) | 35 parts |
| C. I. pigment yellow 180 (tradename Nobapalm yellow-PH-G, manufactured by Hext Co.) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan Ink C2]

Cyan colored-dispersant element having an average grain size of 120 nm is produced using anionic high molecular P-1 as dispersing agent, and moreover, using the following materials by conducting dispersing treatment in the same manner as the carbon black dispersing element.

(Composition of Cyan Colored-dispersing Element)

| | |
|---|---|
| P-1 aqueous solution (having solid ingredient of 20%) | 30 parts |
| C. I. pigment blue 15:3 (trade name: Fastogen blue FGF, manufactured by Dainippon Ink Kagaku Kogyo Co.) | 24 parts |
| glycerol | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta Ink M2]

Magenta color dispersing element having an average grain size of 115 nm is produced by using the anionic high molecular P-1 used when producing the black ink K2 as dispersing agent, and moreover, using the following materials in the same manner as that in the case of the carbon black dispersing agent.

(Composition of the Magenta Colored Dispersing Element)

| | |
|---|---|
| P-1 aqueous solution (having a solid ingredient of 20%) | 20 parts |
| C. I. pigment red 122 (manufactured by Dainippon Ink Kagaku Kogyo Co.) | 24 parts |
| glycerol | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

Next, description will be made below with respect to an ink jet apparatus constructed in accordance with a second embodiment of the present invention.

Figure 5:
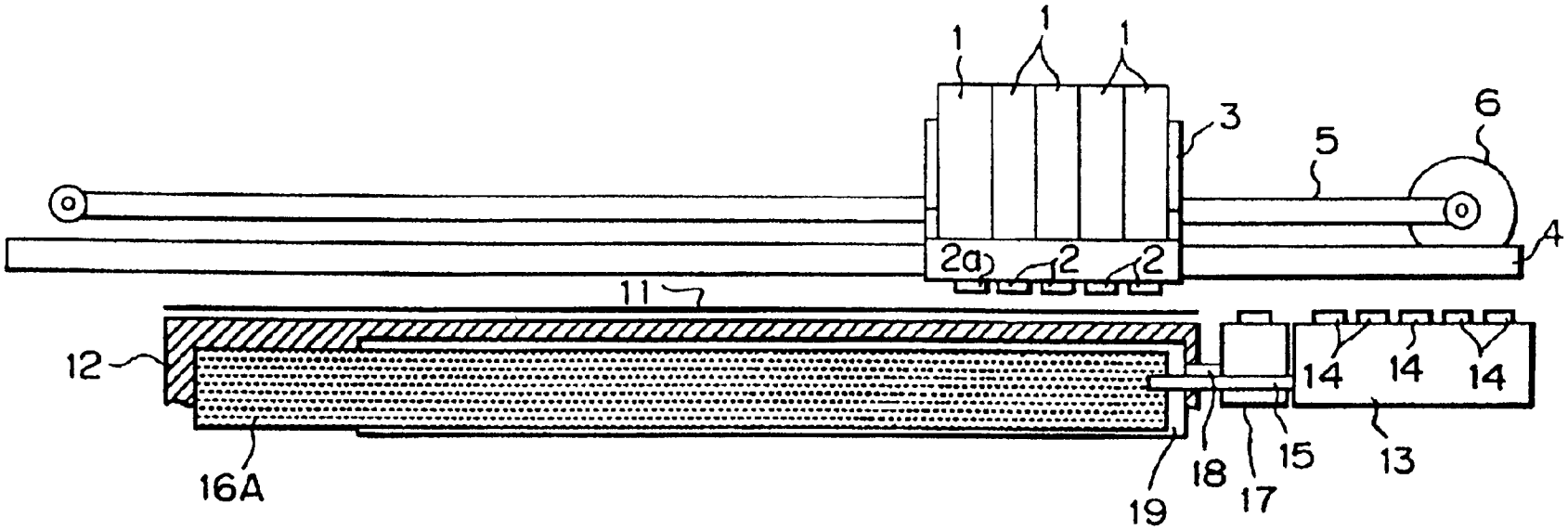
FIG. 5 is a front view which schematically shows the structure of an ink jet apparatus constructed in accordance with a second embodiment of the present invention.
Figure 6:
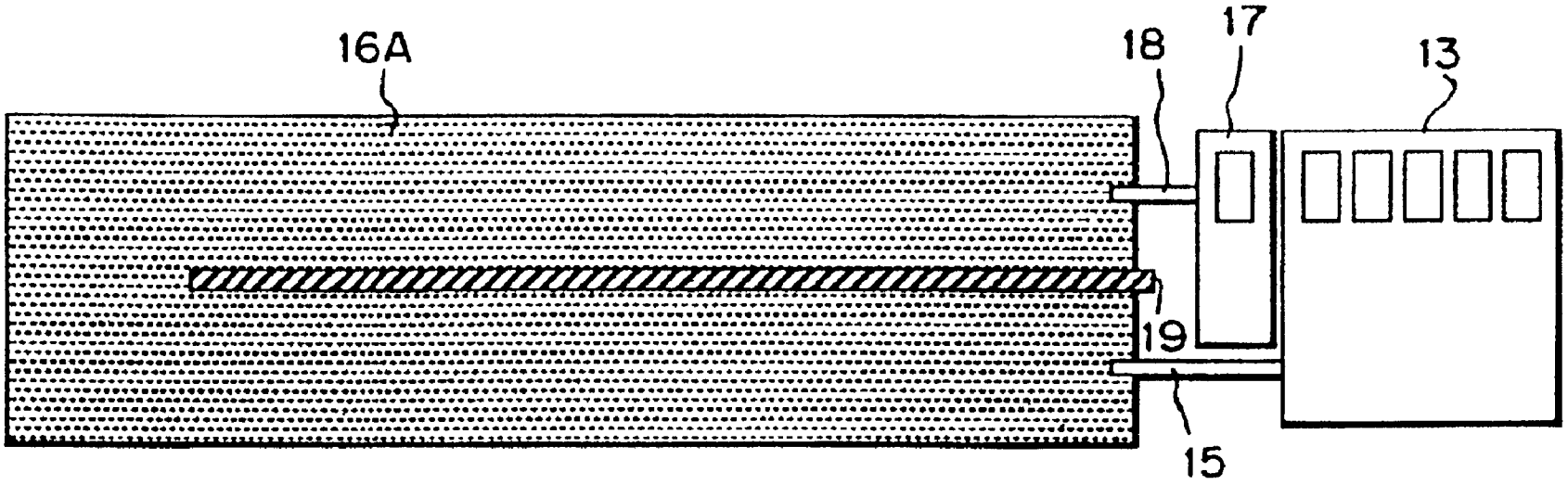
FIG. 6 is a plan view of the ink jet apparatus shown in FIG. 5.

As shown in FIG. 5 which schematically shows the front contour of the ink jet apparatus constructed in accordance with the second embodiment of the present invention and FIG. 6 which schematically shows the contour of the ink jet apparatus as seen from the above, a carriage having a plurality of ink jet cartridges mounted thereon and associated components, an ink jet head and a conveying system are same as those in the first embodiment of the present invention. Thus, same components are represented by same reference numerals, and description on these components will be herein omitted for the purpose of simplification. Incidentally, the carriage and associated components and the paper conveyance system are not shown in FIG. 6 that is a plan view of the ink jet printing apparatus.

In this embodiment, a recovering unit 13 is disposed on the home position side located at a predetermined right-hand position as shown in FIG. 5. In the recovering unit 13, a plurality of cap units 14 are disposed corresponding to respective ink jet head portions 2 of a plurality of ink jet cartridges 1, and the cap units 14 can be raised and lowered in the vertical direction. The cap head units 14 are connected to ink jet head portions 2 to cap the latter therewith when the carriage 3 is situated at a home position, in order to prevent an occurrence of incorrect ejection due to increased viscosity of ink and setting induced by vaporization of the ink in ink ejection ports.

The recovering unit 13 is equipped with a pump unit (not shown). This pump unit serves to generate negative pressure for suction recovering treatment to be conducted while the cap units 14 are connected to the ink jet head portions 2 in the case that the ink jet head portions 2 become to incorrectly eject ink. during suction recovering treatment, ink from the ink jet head is absorbed in a waste liquid absorbing substance 16A from the pump unit via a tube 15.

On the other hand, in this embodiment, a treatment liquid recovering system unit 17 disposed exclusively for a cartridge having treatment liquid received therein is arranged between the recovering system unit 13 and the waste liquid absorbing substance 16A. The treatment liquid recovering system unit 17 is equipped with a pump unit (not shown) like the recovering system unit 13 so as to conduct suction recovering treatment in the case that a treatment liquid ejecting head becomes to incorrectly eject treatment liquid. By conducting the recovering treatment, the treatment liquid ejected from the head is absorbed in the waste liquid absorbing substance 16A via a tube 18. The reason why the treatment liquid recovering system unit 17 is arranged separate from the recovering system unit 13 is to avoid an occurrence of incorrect suction of the pump unit due to increased viscosity induced by mixing ink with the treatment liquid in the pump.

A characterizing feature of this embodiment consists in arrangement of the waste liquid absorbing substance 16A in a U-shaped configuration as shown in FIG. 6 that is a plan view of the ink jet apparatus. The opposite ends of the U-shaped waste liquid absorbing substance 16A are located on the right-hand side as seen in the drawing, and a discharge end of the ink tube 15 is inserted in one end of the U-shaped waste liquid absorbing substance 16A while a discharge end of a treatment liquid tube 18 is inserted into other end of the same. A boundary rib member 19 is fitted into an inner hollow portion of the U-shaped configuration of the waste liquid absorbing substance 16A so that ink absorbed in one end do not permeate to the other end across the rib member 19.

Next, a manner of permeation into the waste liquid absorbing substance 16A in accordance with this second embodiment will be described below.

Figure 7:
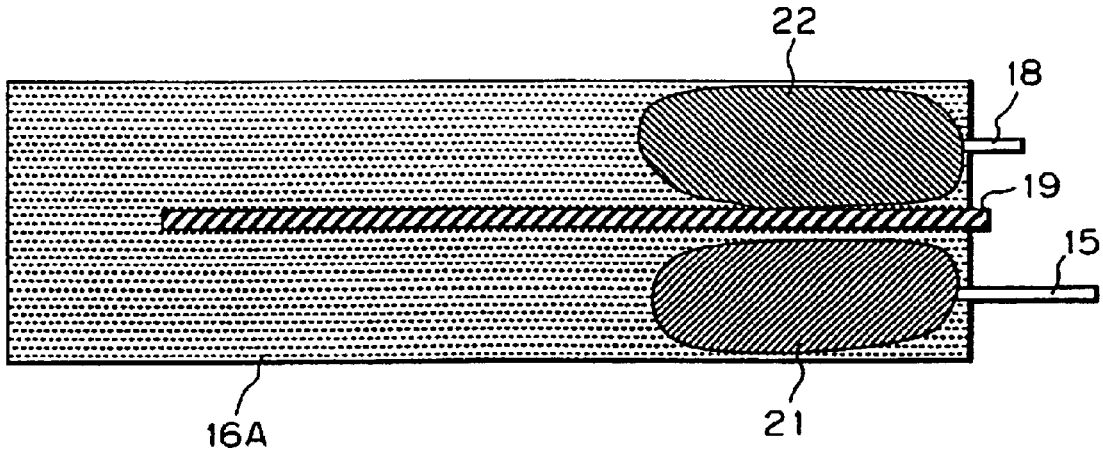
FIG. 7 is a schematic view which shows that a waste liquid absorbing substance of the second embodiment is not saturated.
Figure 8:
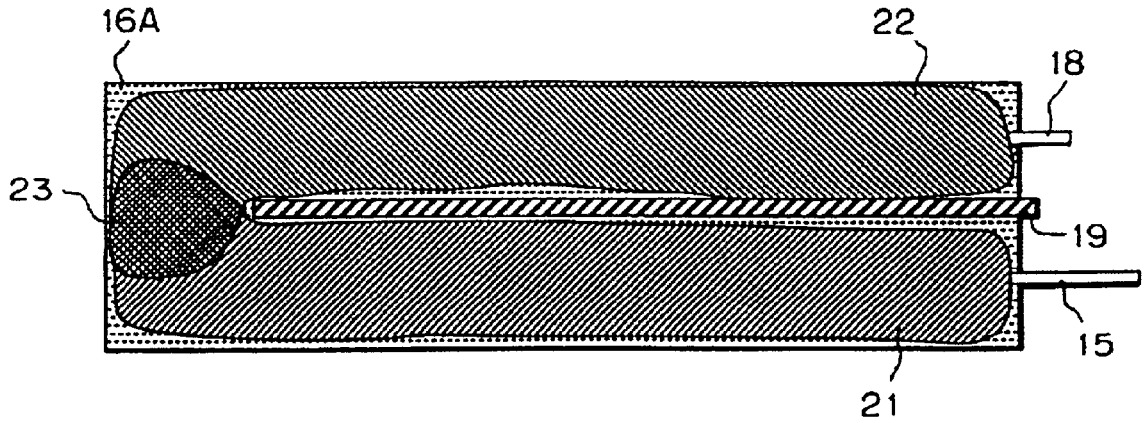
FIG. 8 is a schematic view which shows that the waste liquid absorbing substance of the second embodiment is saturated with waste liquids.
Figure 9:
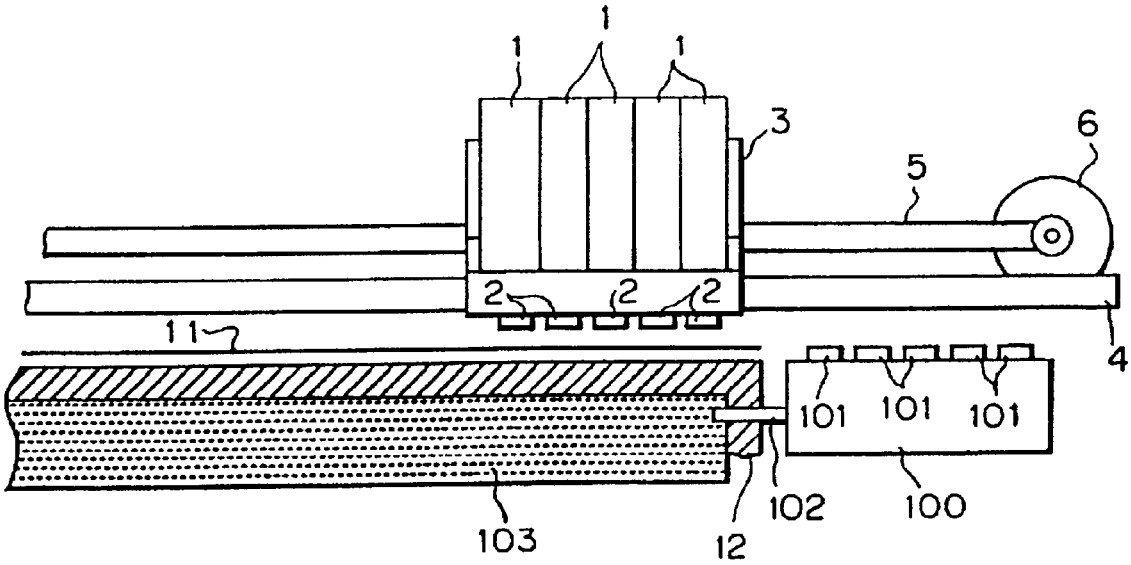
FIG. 9 (PRIOR ART)
FIG. 9 is a front view which schematically show the structure of a conventional ink jet apparatus.

FIG. 7 and FIG. 8 show how the waste liquid is absorbed in the waste liquid absorbing substance 16A. Particularly, FIG. 7 shows the state that the waste liquid absorbing substance 16A has some allowance in capacity, and FIG. 8 shows that the waste liquid absorbing substance 16A is substantially saturated with the waste liquids.

In the state as shown in FIG. 7, ink waste liquid 21 and treatment waste liquid 22 absorbed in the waste liquid absorbing substance 16A past the tubes 15 and 18 are separately stored at the opposite ends of the U-shaped waste liquid absorbing substances 16A. Thus, it can be considered that two kinds of waste liquids are absorbed in separate waste liquid absorbing substances. Since two waste liquids do not interfere with each other, there does not arise a malfunction associated with increased viscosity or setting. Consequently, there is not a factor of obstructing absorption of the waste liquid.

On the other hand, in the state shown in FIG. 8, the waste liquid substance 16A is substantially saturated with two kinds of waste liquids, and a jelly-like reaction product 23 formed by reaction of the two waste liquids is located at the central part of the U-shaped configuration of the waste liquid absorbing substance 16A. Since the waste liquid absorbing substance 16A is already saturated, the jelly-like reaction product 23 does not obstruct absorption of the waste liquids.

A balance between a quantity of waste treatment liquid and a quantity of waste ink varies depending on various factors such as humidity, temperature, frequency of printing operations. However, since the position where both liquids mix with each other is automatically adjusted even when the balance between the waste ink and the waste liquid is largely deviated from the neutral state, both the waste liquids can be absorbed in the whole volume of the waste liquid absorbing substance 16A. Thus, the volume of the waste liquid absorbing substance 16A can be minimized, resulting in the cost of the apparatus being reduced. In addition, since the absorbing efficiency of the waste liquids is increased, there is no need of replacing the waste liquid absorbing substance 16A with another one or a frequency of replacing the waste liquid absorbing substance 16A with another one is few.

Additionally, in this embodiment, it is possible to accommodate two pumps for ink and pretreatment liquid in a single recovering unit, it is possible to fabricate the apparatus at a reduced cost, and moreover, it is possible to design the apparatus with smaller dimensions as seen in the direction of a width. The gap of the U-shaped portion of the waste liquid absorbing substance 16A can easily be formed by press molding. Since a rib member 19 can easily be disposed for an outer case serving also as an accommodating case for the waste liquid absorbing substance 16A by employing an integral molding process, there is not substantially any factor for producing the apparatus at an increased cost.

As mentioned above, in this embodiment, in addition to an advantages as mentioned with respect to the first embodiment, the apparatus can be designed with smaller dimensions, and moreover, the apparatus can be produced at more reduced cost.

In this embodiment, the waste liquid absorbing substance 16A having a U-shaped configuration is formed in the horizontal direction. Alternatively, the U-shaped configuration of the waste liquid absorbing substance 16A may be formed in the vertical direction so that the waste liquids are absorbed in waste liquid absorbing substance 16A from the opposite ends of the U-shaped configuration.

The present invention has been described in detail with respect to preferred embodiments, and it will be now be that changes and modifications may be made without departing from the invention in its broader aspects, and it is the intention, therefore, in the appended claims to cover all such changes and modifications as fall within the true spirit of the invention.

What is claimed is:

1. An ink jet apparatus for printing on a printing medium with ink and treatment liquid having a function of setting ink, said apparatus comprising:

an ink ejection port for ejecting ink;

a treatment liquid ejection port for ejecting treatment liquid;

a waste liquid accommodating substance for accommodating waste liquid;

a first introducing means for introducing waste ink discharged by recovery operation from said ink ejection port into a first portion of said waste liquid accommodating substance; and a second introducing means for introducing, independently of waste ink, waste treatment liquid discharged by recovery operation from said treatment liquid ejection port into a second portion separated from said first portion of said waste liquid accommodating substance.

2. An ink jet apparatus as claimed in claim 1, wherein said waste liquid accommodating substance is formed in a U-shaped configuration.

3. An ink jet apparatus as claimed in claim 1 or claim 2, wherein said treatment liquid contains a cationic material composed of a low molecular weight ingredient and a high molecular weight ingredient, and said ink contains an anionic dye.

4. An ink jet apparatus as claimed in claim 1 or claim 2, wherein said treatment liquid contains a cationic material composed of a low molecular weight ingredient and a high molecular weight ingredient, and said ink contains an anionic dye or at least an anionic compound and a pigment.

5. An ink jet apparatus as claimed in claim 1, further comprising an ink jet head which includes, as an energy generating element, an electrothermal transducer for generating thermal energy so as to allow a phenomenon of film boiling to appear in ink.

6. An ink jet apparatus for printing on a printing medium with a first liquid and a second liquid different from the first liquid, the first liquid and the second liquid reacting to each other, said apparatus comprising:

a first ejection port for ejecting the first liquid;

a second ejection port for ejecting the second liquid; and a waste liquid accommodating substance for accommodating waste liquid, wherein said waste liquid accommodating substance receives the first liquid discharged by recovery operation from said first ejection port at a first portion of said waste liquid accommodating substance and receives, independently of the first liquid, the second liquid discharged by recovery operation from said second ejection port at a second portion of said waste liquid accommodating substance separated from said first portion of said waste liquid accommodating substance.

* * * * *

UNITED STATES PATENT AND TRADEMARK OFFICE

CERTIFICATE OF CORRECTION

PATENT NO. : 6,786,567 B1
DATED : September 7, 2004
INVENTOR(S) : Yoshino

It is certified that error appears in the above-identified patent and that said Letters Patent is hereby corrected as shown below:

Title page,
Item [30], Foreign Application Priority Data, "6/210218" should read -- 6-210218 --.
Item [57], ABSTRACT,
Line 10, "treatment" should read -- treatment --.

Column 1,
Lines 41 and 58, "can not" should read -- cannot --.

Column 2,
Line 28, "can not" should read -- cannot --.
Line 60, "or" should read -- on --.
Line 62, "supported" should read -- supported by --.

Column 5,
Line 16, "show" should read -- shows --.

Column 6,
Line 20, "can not" should read -- cannot --.

Column 7,
Line 13, "few" should read -- a low --.
Line 38, "fuloropore" should read -- Fluoropore --.

Column 11,
Line 5, "become" should read -- come --.
Line 17, "becomes" should read -- comes --.

UNITED STATES PATENT AND TRADEMARK OFFICE

CERTIFICATE OF CORRECTION

PATENT NO. : 6,786,567 B1
DATED : September 7, 2004
INVENTOR(S) : Yoshino

It is certified that error appears in the above-identified patent and that said Letters Patent is hereby corrected as shown below:

Column 12,
Line 14, “few.” should read -- low. --.
Line 28, “an” should be deleted.
Line 40, “be” (first occurrence) should be deleted.

Signed and Sealed this

Twenty-fourth Day of May, 2005

JON W. DUDAS
*Director of the United States Patent and Trademark Office*